United States Patent [19]

Duarte

[11] Patent Number: 4,836,104

[45] Date of Patent: Jun. 6, 1989

[54] SHEET TRANSFER MECHANISM FOR A FRESHLY PRINTED SHEET

[75] Inventor: Eduardo Duarte, Irving, Tex.

[73] Assignee: Duarte Products, Inc., Irving, Tex.

[21] Appl. No.: 58,892

[22] Filed: Jun. 5, 1987

[51] Int. Cl.[4] ..... B41F 13/08

[52] U.S. Cl. ..... 101/420; 271/195

[58] Field of Search ..... 101/420; 406/88; 271/276, 194, 195; 226/7, 97

[56] References Cited

U.S. PATENT DOCUMENTS

| | | | |
|---|---|---|---|
| 1,201,788 | 10/1916 | Yetter | 101/420 X |
| 2,730,950 | 1/1956 | Grassi | 101/420 |
| 2,736,106 | 2/1956 | Offen | 101/420 X |
| 3,308,522 | 3/1967 | Miller | 101/420 X |
| 3,542,358 | 11/1970 | Schuhmann | 101/420 X |
| 4,402,267 | 9/1983 | DeMoore | 101/419 |
| 4,552,069 | 11/1985 | Jahn | 101/420 |
| 4,572,073 | 2/1986 | Mitze et al. | 101/419 X |
| 4,688,784 | 8/1987 | Wirz | 271/195 |
| 4,694,750 | 9/1987 | Greene | 101/420 X |

FOREIGN PATENT DOCUMENTS

| | | | |
|---|---|---|---|
| 261143 | 6/1913 | Fed. Rep. of Germany | 101/420 |
| 3422443 | 12/1985 | Fed. Rep. of Germany . | |

*Primary Examiner*—Clifford D. Crowder

*Attorney, Agent, or Firm*—Crutsinger & Booth

[57] ABSTRACT

A sheet transfer mechanism comprising a gripper bar which engages the leading edge of a freshly printed sheet to move the sheet along a curved path and a sheet guide member having a guide surface formed thereon which has a radius of curvature significantly less than the radius of curvature of the curved path to guide the sheet along the path while the printed surface of the sheet is separated from the guide surface by an air cushion. At least a portion of the guide surface on the guide member is rough to carry a boundary layer of air. The guide surface is positioned relative to a vane to form an air chamber having an air dispensing passage such that rotation of the guide member forces air through the chamber and through the dispensing passage in a direction generally perpendicular to the guide surface to assure that the freshly printed surface on the sheet does not contact the trailing edge of the guide surface. Orifices through the guide surface communicate with the air chamber to deliver streams of air through the guide surface.

8 Claims, 3 Drawing Sheets

SHEET TRANSFER MECHANISM FOR A FRESHLY PRINTED SHEET

TECHNICAL FIELD

The present invention relates to a method and apparatus for transferring freshly printed sheets between printing stations in a printing press or delivering printed sheets to a stack.

BACKGROUND OF THE INVENTION

Skeleton wheels and transfer cylinders are conventionally employed in printing presses for conveying freshly printed sheets. Sheets are often "marked" when freshly printed surfaces contact the surface of skeleton wheels and transfer cylinders as a result of smearing the ink or causing ink to be offset onto the transfer cylinder or skeleton wheel and then reapplied to the printed sheet.

U.S. Pat. No. 4,402,267 discloses a Teflon (a registered trademark of E.I. Dupont de Nemours for a tetrafluroethylene material) covered skeleton wheel, to provide an ink repellent coating covered by a loosely supported gauze covering. The surface of the skeleton wheel is described as being ink repellent and polished such that the gauze is free to move slightly over the ink repellent support surface such that a printed sheet is supported and transferred by the skeleton wheel such that the freshly printed sheet is not marred. However, under certain printing conditions ink is transferred to the gauze which must be replaced often.

SUMMARY OF INVENTION

The sheet transfer mechanism disclosed herein forms an air cushion adjacent a guide surface such that the direction of travel of the sheet is precisely controlled while the freshly printed surface of the sheet is supported on the cushion of air to prevent offsetting of ink from the sheet to the guide surface. The guide surface is roughed such that a boundary layer of air is carried by the guide surface and is maintained between the freshly printed surface of the sheet and the guide surface. The roughened guide surface may be formed by detachably securing strips or dots of sandpaper-like material to a curved surface on the guide member. In the event that ink accumulates on the roughened surface, under extreme printing conditions, the strips of sandpaper are replaceable.

The sheet guide member comprises an arcuate sheet guide member and a vane secured to a central spoke rotatable about a sheet transfer axis. The radius of curvature of the sheet guide surface on the guide member is significantly less than the radius of curvature of the path along which a gripper carries the leading edge of the sheet.

The guide member is provided with a vane having a trailing edge positioned relative to the trailing edge of the guide surface to form an air dispensing passage through which air is dispensed, as the guide member rotates, to assure that the trailing edge of the guide surface is not engaged by the printed surface on the sheet.

DESCRIPTION OF DRAWING

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 6:
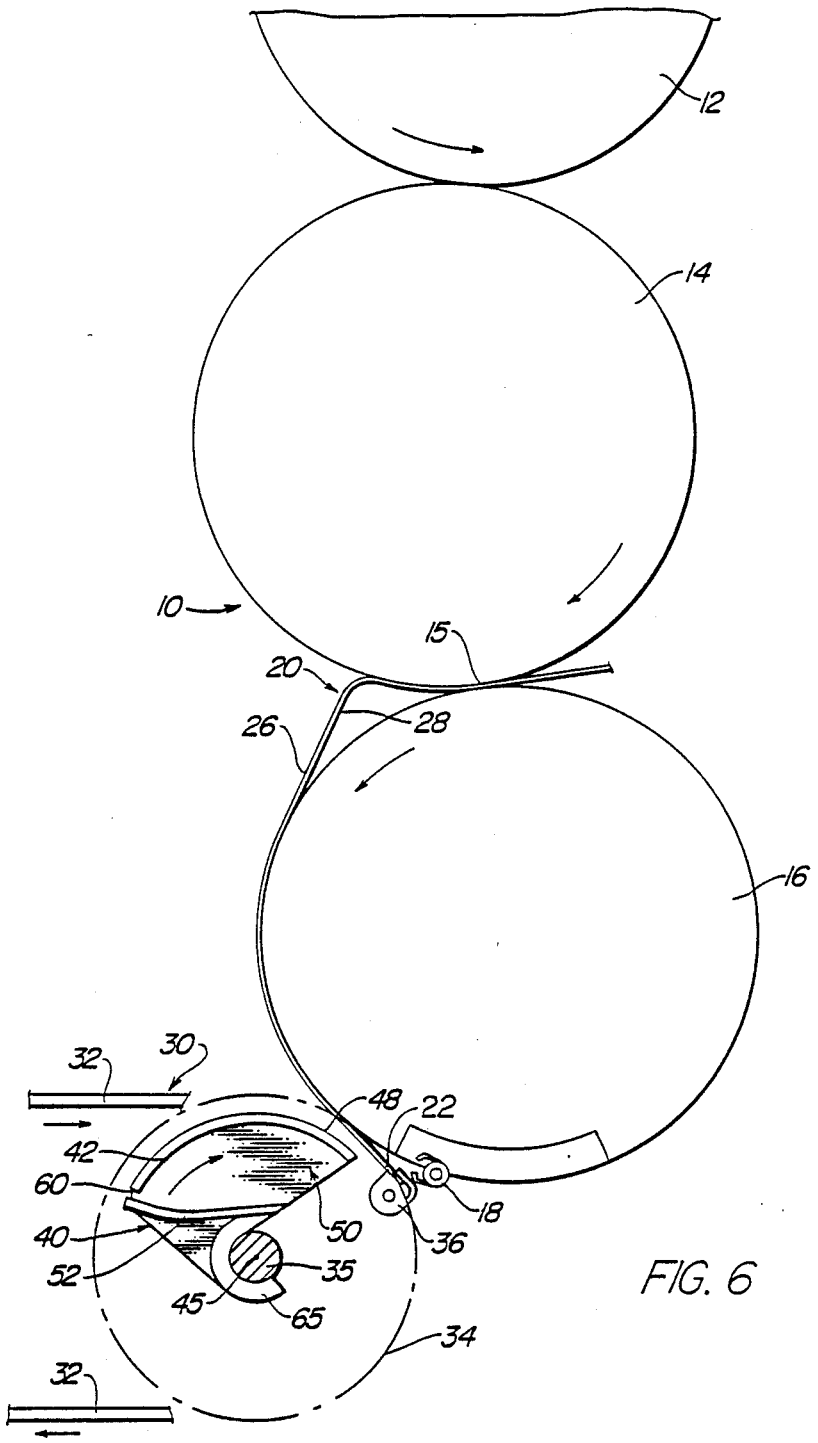
FIG. 6 is a diagrammatic view of the sheet guide member mounted in a sheet transfer mechanism in a delivery station of a printing press.

Referring to FIG. 6 of the drawing, the numeral 10 generally designates a printing press. Printing press 10 may assume any desired configuration. However, the illustrated embodiment is a lithographic sheet-fed printing press comprising a plate cylinder 12, a blanket cylinder 14 and an impression cylinder 16. Impression cylinder 16 is equipped with a sheet gripper 18 which engages the leading edge 22 of a sheet 20 for moving the sheet through a printing nip 15 between blanket cylinder 14 and impression cylinder 16.

Ink is applied to image areas of a printing plate on plate cylinder 12 and is transferred to the surface of a blanket carried by blanket cylinder 14. The image is transferred from the blanket to the printed surface 26 of sheet 20. The tack of the ink on blanket cylinder 14 causes the printed surface 26 of sheet 20 to stick to the surface of blanket cylinder 14 such that sheet 20 must be pulled away from the surface on blanket cylinder 14.

Plate cylinder 12, blanket cylinder 14 and impression cylinder 16 are of conventional design and well known to those skilled in the lithographic printing art.

The sheet transfer mechanism, generally designated by the numeral 30 in FIG. 6 of the drawing, may assume a variety of configurations. The illustrated embodiment of sheet transfer mechanism 30 comprises a pair of chains 32 carrying gripper bars 36 which are driven by sprockets 34 mounted on a shaft 35 which is rotatable about an axis 45. Conventional skeleton wheels and transfer cylinders heretofore devised have been mounted on shaft 35 and have had a radius of curvature substantially equal to the pitch line of gear 34. The freshly printed surface 26 on sheet 20 physically contacted surfaces on the skeleton wheels and transfer cylinders which caused the freshly printed ink to be applied to the skeleton wheel or transfer cylinder.

The pitch diameter of sprocket 34 is illustrated in dashed outline in FIG. 6.

A sheet guide member generally designated by the numeral 40 in FIG. 6 of the drawing is mounted on shaft 35 and rotates about axis 45.

Figure 1:
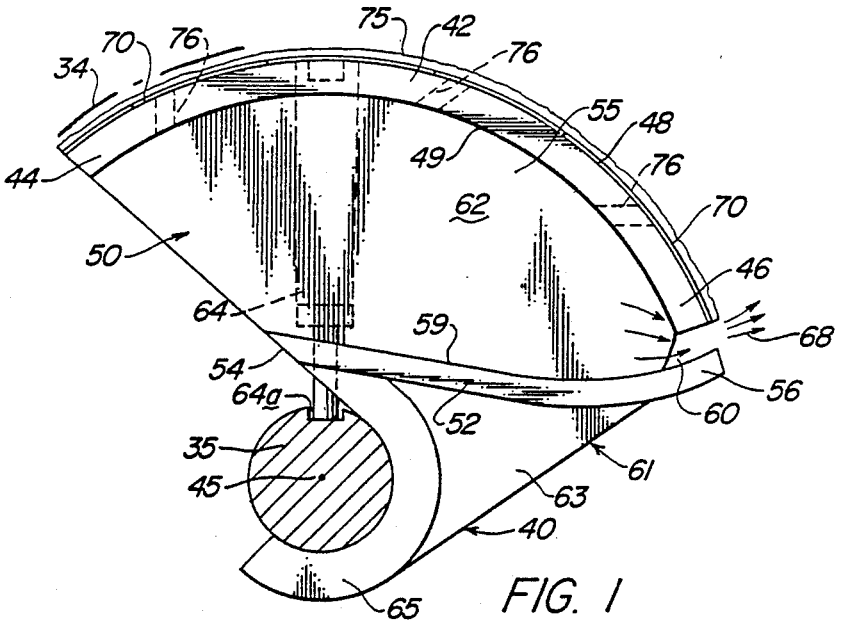
FIG. 1 is a side elevational view of a sheet guide member.
Figure 2:
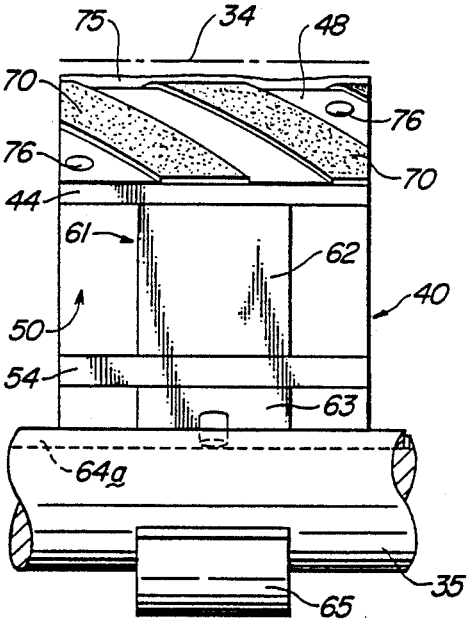
FIG. 2 is a front elevational view thereof.
Figure 3:
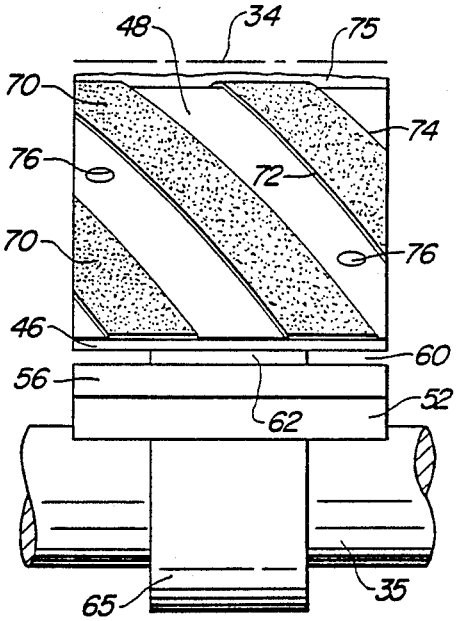
FIG. 3 is a rear elevational view thereof.

Referring to FIGS. 1, 2 and 3 of the drawing, sheet guide member 40 comprises an arcuate guide segment 42 and a vane 52 secured to a spoke, an upper portion 62 of the spoke extending between guide segment 42 and vane 52. A lower portion 63 of the spoke extends from vane 52 and has a hub 65 formed on the lower end thereof. As best illustrated in FIG. 1 of the drawing, hub 65 extends around slightly less than 180° of the circumference of shaft 35 and is locked onto shaft 35 by a set screw 64.

The arcuate guide segment 42 has a leading edge 44 and a trailing edge 46 with a curved outer guide surface 48 extending therebetween. Vane 52 has a leading edge 54 and a trailing edge 56. As best illustrated in FIG. 1 of the drawing, guide segment 42 is spaced from vane 52, forming a chamber 55 between inner surface 49 on guide segment 42 and inner wall 59 on vane 52. The upper portion 62 of the spoke extends between central portions of guide segment 42 and vane 52, as best illustrated in FIG. 2, to form spaced entrance openings 50 into air chamber 55. Trailing edges 46 and 56 of guide segment 42 and vane 52, respectively, are closely spaced to form an air dispensing passage 60 therebetween. The cross-section of chamber 55 diminishes from entrance opening 50 toward air dispensing passage 60 such that a stream 68 of high velocity air flows through dispensing passage 60 to impinge against the freshly printed surface 26 on sheet 20 to assure that trailing edges 46 and 56 are separated from printed surface 26 of sheet 20. Vane 52 is curved and shaped adjacent trailing edge 56 to direct air stream 68 generally radially of and perpendicular to guide surface 48.

Guide surface 48 on the arcuate guide segment 42 is roughened to cause a boundary layer 75 of air to be carried adjacent guide surface 48 to provide a cushion of air to maintain the printed surface 26 on sheet 20 separated from guide surface 48 preventing physical contact therebetween.

In the illustrated embodiment, strips 70 of sandpaper are bonded to guide surface 48. Strips 70 are angularly disposed across guide surface 48 and substantially skewed relative to the path of rotation traveled by guide surface 48. Strips 70 preferably do not cover the entire guide surface 48. As best illustrated in FIGS. 3 and 4 of the drawing, edges 72 and 74 of each strip 70 are spaced apart leaving a portion of guide surface 48 therebetween exposed.

Orifices 76 extend through guide segment 42 for delivering streams of air from air chamber 55 to impinge against the surface of sheet 20.

Figure 4:
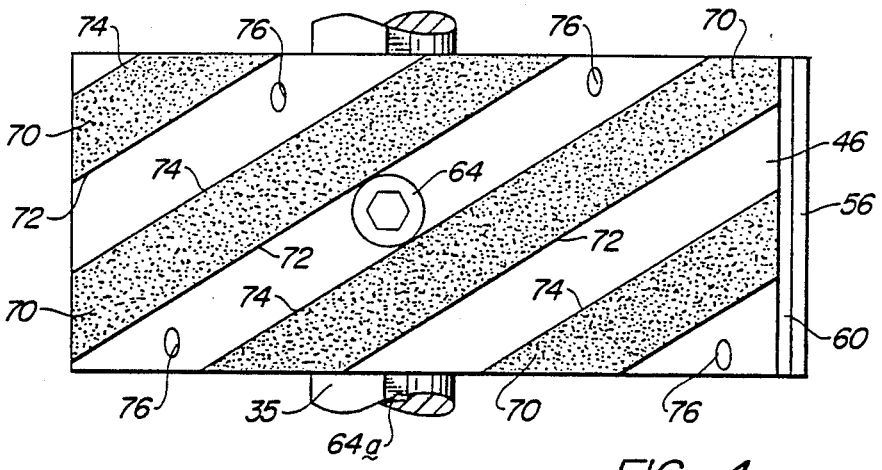
FIG. 4 is a top plan view thereof.
Figure 5:
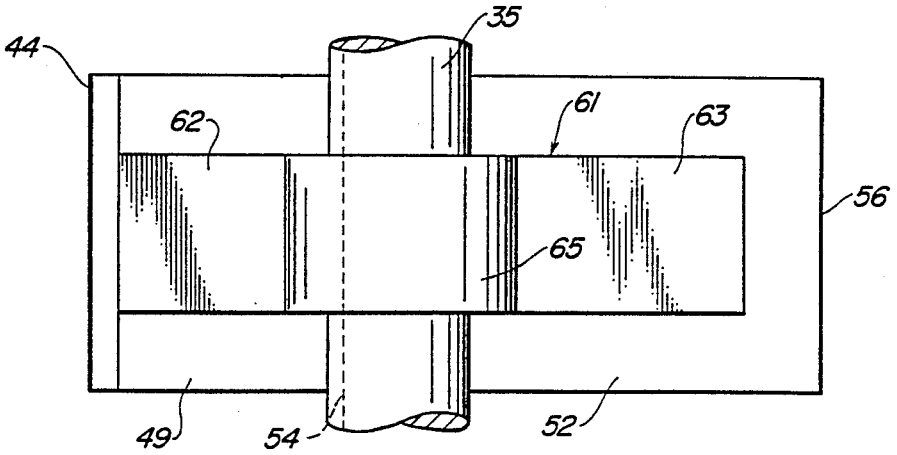
FIG. 5 is a bottom view.

As best illustrated in FIGS. 1 and 4 of the drawing, set screw 64 preferably has an enlarged upper portion having threads on the outer surface thereof which engage an internally threaded aperture extending through arcuate guide segment 42 and the upper portion 62 of the spoke 61 and has a non-threaded reduced diameter portion extending through a central portion of vane 52 which engages shaft 35. It should be readily apparent that set screw 64 can be loosened to permit adjustment of sheet guide member 40 longitudinally of shaft 35. When sheet guide member 40 is in the desired position, set screw 64 can be tightened preventing relative movement between guide member 40 and shaft 35. The end of setscrew 64 extends into a keyway **64*a* in shaft 35 to angularly position the sheet guide member 40 relative to gripper bars 36**.

Sheet guide member 40 is preferably a replacement part for skeleton wheels or transfer cylinders employed in conventional printing presses. In conventional printing presses, the spacing between gripper bars 36 along chains 32 in a delivery station is generally approximately equal to the length of the circumference of impression cylinder 16. In some printing presses, skeleton wheels are provided with two or more gaps or cut-out portions through which gripper bars 36 extend as the skeleton wheel rotates. Sheet guide member 40 will be formed with two guide segments 42 spaced apart to provide two guide surfaces to accommodate gripper bars on these presses.

The mounting structure for skeleton wheels on shaft 35 of different manufacturers varies. It will be appreciated that connectors other than setscrew 64 may be employed for securing hub 65 to shaft 35 and that the configuration of hub 65 will vary to accommodate different shaft designs.

The operation and function of the gripper bar 36 of sheet transfer mechanism 30, illustrated in FIG. 6 of the drawing, is similar to that of sheet transfer mechanisms employed in conventional printing presses. Gipper 18 on impression cylinder 16 is opened by a cam (not shown) to release the leading edge 22 of a sheet 20 as grippers On gripper bar 36 are closed by a cam (not shown). As the grippers on gripper bar 36 engage the leading edge 22 of sheet 20, the direction of travel of the sheet is changed from a path coinciding with the surface of impression cylinder 16 to a path coinciding with the path of travel of chain 32 which initially coincides with the pitch line of sprocket 34.

The radial distance from axis 45 to the outer surface of sandpaper 70 on guide surface 48 is less than the pitch diameter of sprocket 34 in an amount significantly greater than the thickness of the sheet 20 of paper, for example approximately $\frac{1}{4}''$ or more. The boundary layer 75 of air carried adjacent the roughened guide surface 48 on arcuate guide segment 42 of sheet guide member 40 forms a cushion of air which flexes and supports sheet 20 to cause it to move along the arcuate path generally corresponding to the pitch line of gear 34 while separating the freshly printed surface 26 of sheet 20 from guide surface 48.

The width of arcuate guide segment 42 and vane 52 is preferably approximately 25% of the sheet 20 and the length of arcuate guide segment 42 is less than about 30% of the maximum sheet length.

The printed surface 26 of sheet 20 tends to stick to the surface of blanket cylinder 14 at locations corresponding to the image carried on blanket cylinder 14. Thus, if sheet 20 is being printed adjacent the trailing edge 24 thereof, the trailing edge of sheet 20 must be pulled from the surface of blanket cylinder 14 by gripper bar 36. As gripper bar 36 rotates downwardly from the position illustrated in FIG. 6 of the drawing to a position substantially vertically below the axis 45 of shaft 35, the freshly printed surface 26 of sheet 20 will be drawn toward guide surface 48 and particularly toward the trailing edge 46 of arcuate guide segment 42 of sheet guide member 40. Air stream 68 flowing through air dispensing passage 60 impinges against the printed surface 26 of sheet 20 to pneumatically separate the sheet from the trailing edge 46 of guide surface 48 and the trailing edge 56 of vane 52.

From the foregoing it should be readily apparent that the freshly printed surface 26 of sheet 20 is aerodynamically supported by air cushion 75 and is pneumatically urged by air stream 68 to control the path along which sheet 20 travels until after the trailing edge 24 of sheet 20 has passed through printing nip 15 and has been pulled from the surface of blanket cylinder 14.

It should be readily apparent that sheet guide member 40 may assume other and different configurations without departing from the basic concept of the invention. For example, portions of a cylinder may be cut away to form two or more sheet guide members of the type disclosed herein as an integral unit.

What I claim is:

1. A sheet transfer mechanism comprising: sheet gripper means; means to move the gripper means along a curved path about an axis; a sheet guide member rotatable about said axis; an arcuate guide surface having a leading edge and a trailing edge on said guide member;

a vane having a leading edge and a trailing edge spaced from said leading and trailing edges on said guide surface, said vane being positioned relative to said guide surface to form a chamber having an entrance opening between said leading edges and having an air dispensing passage between said trailing edges; and means rotating said sheet guide member in synchronized relation to said gripper means to guide a printed sheet along said path, said entrance opening and said dispensing passage being positioned to form a stream of air to prevent physical contact between the sheet and the guide surface.

2. A sheet transfer mechanism according to claim 1, said vane and said arcuate guide surface being configured to form a stream of air directed generally radially of said guide surface.

3. A sheet transfer mechanism according to claim 1, said arcuate guide surface being adapted to carry a boundary layer of air.

4. A sheet transfer mechanism according to claim 3, said vane being configured to form a stream of air directed generally perpendicular to the surface of a sheet carried by said gripper means.

5. A sheet transfer mechanism according to claim 1, with the addition of roughhead segments on said guide surface to maintain a boundary layer of air adjacent said guide surface.

6. A sheet guide member according to claim 1, said sheet guide member having spaced orifices formed therein which extend through said guide surface such that streams of air from said chamber flow through said guide surface.

7. A sheet guide member adapted for controlling the path of the travel of a freshly printed sheet comprising: sheet guide means having leading and trailing edges and formed to provide an elongated air entrance opening adjacent said leading edge and an elongated air dispensing passage adjacent said trailing edge; and means to rotatably mount said guide means in a printing press, said entrance opening and dispensing passage being configured such that rotation of said guide means forms and directs a stream of air in a direction generally perpendicular to said guide means through said air dispensing passage adjacent the trailing edge of said guide means.

8. A sheet guide member according to claim 7, with the addition of strips of sandpaper-like material bonded to said guide means forming a stationary boundary layer of air to pneumatically support a freshly printed sheet.

* * * * *

UNITED STATES PATENT AND TRADEMARK OFFICE

CERTIFICATE OF CORRECTION

PATENT NO. : 4,836,104

DATED : June 6, 1989

INVENTOR(S) : Eduardo Duarte

It is certified that error appears in the above-identified patent and that said Letters Patent is hereby corrected as shown below:

Column 4, line 7, change "Gipper" to -- Gripper --;

Column 5, line 25, change "roughhead" to -- roughened --.

Signed and Sealed this

Twentieth Day of February, 1990

*Attest:*

JEFFREY M. SAMUELS

*Attesting Officer*

*Acting Commissioner of Patents and Trademarks*